US010064428B2

(12) United States Patent
Swepston et al.

(10) Patent No.: US 10,064,428 B2
(45) Date of Patent: Sep. 4, 2018

(54) ADHESIVE FREE TOBACCO PRODUCT TIP ASSEMBLY

(71) Applicant: ALTRIA CLIENT SERVICES LLC, Richmond, VA (US)

(72) Inventors: Jeffrey A. Swepston, Powhatan, VA (US); Marc D. Belcastro, Glen Allen, VA (US); Christopher L. Simpson, Richmond, VA (US); John D. Thomson, Chester, VA (US); Patrick S. McElhinney, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 343 days.

(21) Appl. No.: 14/579,791

(22) Filed: Dec. 22, 2014

(65) Prior Publication Data

US 2015/0181927 A1 Jul. 2, 2015

Related U.S. Application Data

(60) Provisional application No. 61/920,980, filed on Dec. 26, 2013.

(51) Int. Cl.

| | |
|---|---|
| ***A24F 13/02*** | (2006.01) |
| ***A24F 13/08*** | (2006.01) |
| ***A24F 7/00*** | (2006.01) |
| ***A24F 9/14*** | (2006.01) |
| ***A24D 1/04*** | (2006.01) |
| *A24F 13/22* | (2006.01) |

(52) U.S. Cl.

CPC ..... *A24D 1/042* (2013.01); *A24F 7/00* (2013.01); *A24F 13/08* (2013.01); *A24F 13/22* (2013.01)

(58) Field of Classification Search

CPC .... A24F 13/06; A24F 7/02; A24F 7/00; A24F 13/08; A24F 13/02; A23F 7/04

USPC ..... 131/175, 187, 188

See application file for complete search history.

(56) References Cited

U.S. PATENT DOCUMENTS

| | | | | |
|---|---|---|---|---|
| 266,582 A | | 10/1882 | Demuth | |
| 359,358 A | | 3/1887 | Mish | |
| 394,575 A | | 12/1888 | James | |
| 608,170 A | | 8/1898 | Bigelow | |
| 840,853 A | | 1/1907 | King | |
| 1,023,288 A | | 4/1912 | Wolleson | |
| 1,209,596 A | | 12/1916 | Krystyniak | |
| 1,293,529 A | * | 2/1919 | Parker | A24F 13/14 131/175 |

(Continued)

FOREIGN PATENT DOCUMENTS

| | | | | |
|---|---|---|---|---|
| FR | 957278 A | * | 2/1950 | A24F 13/08 |
| GB | 190108507 A | * | 0/1901 | |

(Continued)

*Primary Examiner* — Alex Efta

(74) *Attorney, Agent, or Firm* — Harness, Dickey & Pierce, P.L.C.

(57) ABSTRACT

A tobacco product tip assembly. The tobacco product tip assembly includes a tip portion comprising a tip wall defining an inhalation chamber; the tip portion extending into a body portion comprising a body wall defining an insertion chamber, the insertion chamber being in communication with the inhalation chamber; the body wall comprising a mechanical fastener. A tobacco product assembly and a process for producing a tobacco product assembly are also included.

10 Claims, 1 Drawing Sheet

(56) References Cited

U.S. PATENT DOCUMENTS

| | | | | | |
|---|---|---|---|---|---|
| 1,457,251 | A | * | 5/1923 | Winsor | A24F 13/10 131/182 |
| 1,843,225 | A | * | 2/1932 | Hein | A24F 13/02 131/182 |
| 1,904,814 | A | | 4/1933 | Anzelewitz | |
| 1,938,524 | A | * | 12/1933 | Ground | A24F 13/08 131/188 |
| 2,169,310 | A | | 8/1939 | Wertheimer | |
| 2,454,631 | A | * | 11/1948 | Zalman | A24F 13/14 131/175 |
| 2,685,291 | A | * | 8/1954 | Taylor | A24F 7/00 131/229 |
| 2,869,558 | A | | 1/1959 | Redford | |
| 3,050,068 | A | | 8/1962 | Primus | |
| 3,053,261 | A | | 9/1962 | Sieven | |
| 3,260,266 | A | * | 7/1966 | Miller | A24F 13/04 131/187 |
| 3,646,944 | A | | 3/1972 | Banoczi | |
| 4,046,153 | A | * | 9/1977 | Kaye | A24F 13/08 131/187 |
| D634,065 | S | * | 3/2011 | Borushek | D27/170 |

FOREIGN PATENT DOCUMENTS

| | | | | | |
|---|---|---|---|---|---|
| GB | 191110854 | A | * | 0/1911 | A24F 13/08 |
| GB | 191206153 | A | * | 0/1912 | A24F 13/08 |

* cited by examiner

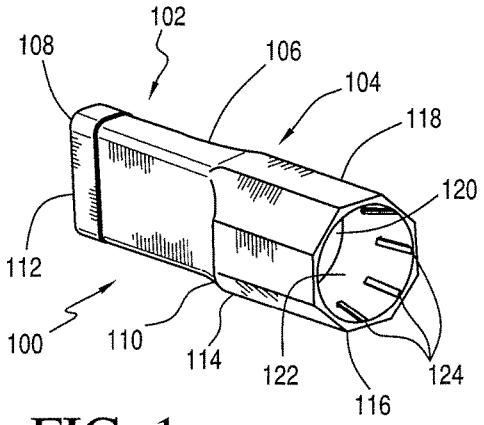
FIG. 1
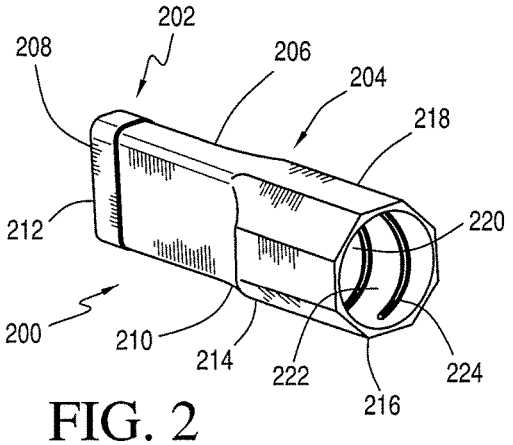
FIG. 2
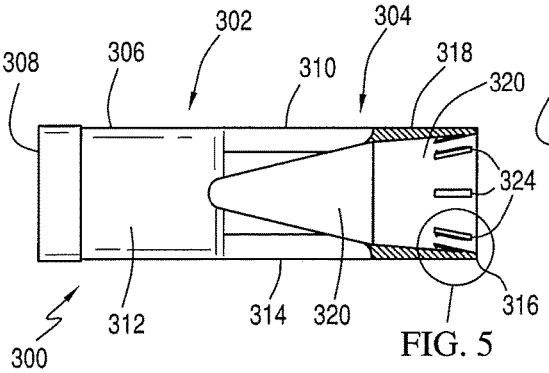
FIG. 5
FIG. 3
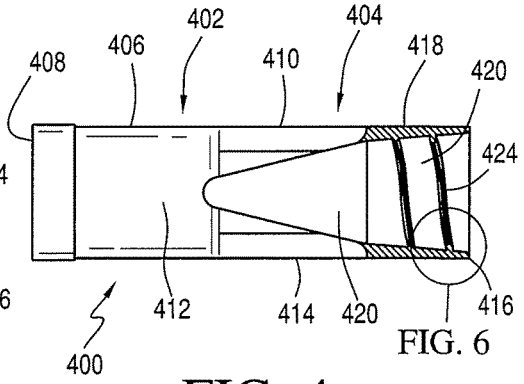
FIG. 6
FIG. 4
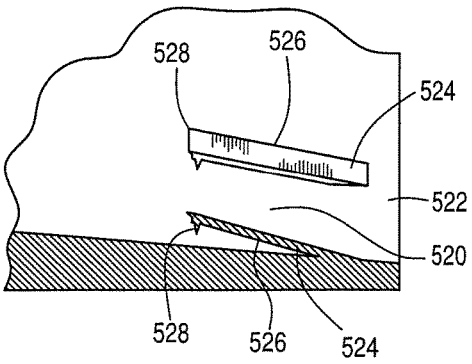
FIG. 5
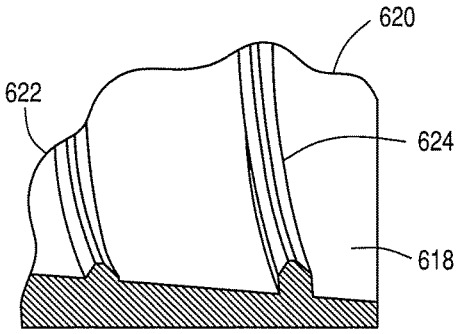
FIG. 6

ADHESIVE FREE TOBACCO PRODUCT TIP ASSEMBLY

RELATED APPLICATION

This application claims priority to U.S. Provisional Application No. 61/920,980, filed on Dec. 26, 2013, the contents of which are hereby incorporated by reference in their entirety.

FIELD

The present invention relates generally to tobacco products ("smoking articles"), e.g., cigars or cigarettes. More specifically, the present invention relates to a tip assembly that may be fastened to a cigar or cigarette.

Environment

Occasionally, during the smoking of an un-tipped cigar or cigarette, the butt end of the cigar or cigarette may develop minor structural issues. For example, the contact of the butt end with the mouth of the consumer leads to the moistening of the tobacco. Also, the butt end has been known to fray and/or separate. In an effort to eliminate some of these problems, mouthpieces or tips have been developed. Tips generally serve as a barrier between the tobacco and the mouth of the consumer, thus ameliorating (at least partially) some of the moisture-related structural problems.

Certain conventional tip assemblies rely on constrictional "frictional" fits, which sometimes fail to provide sufficient attachment to the tobacco product. In some cases, the tobacco product may become disengaged from the tip assembly. To address this problem, tip assemblies employing an adhesive fastening mechanism were developed. Although the adhesive improves the attachment of the tobacco product to the tip assembly, the adhesive creates processing problems. For example, the adhesive may migrate into the production machinery, which may lead to significant machine downtime for cleaning and maintenance.

As such, the need exists for an adhesive-free tobacco product tip assembly that provides improved attachment of the tip assembly to a tobacco product without the processing problems associated with adhesive-containing tip assemblies.

BRIEF DESCRIPTION OF DRAWINGS

The forms disclosed herein are illustrated by way of example, and not by way of limitation, in the figures of the accompanying drawings and in which like reference numerals refer to similar elements and in which:

FIG. 1 presents a perspective view of one form of a tobacco product tip assembly in accordance herewith;

FIG. 2 presents a perspective view of one form of a tobacco product tip assembly in accordance herewith;

FIG. 3 presents a longitudinal cross-sectional view of the tobacco product tip assembly shown in FIG. 1;

FIG. 4 presents a longitudinal cross-sectional view of the tobacco product tip assembly shown in FIG. 2.

FIG. 5 presents an enlarged detail view of the mechanical fasteners of the form shown in FIG. 1.

FIG. 6 presents an enlarged detail view of the mechanical fasteners of the form shown in FIG. 2.

SUMMARY

In one form, a tobacco product tip assembly is disclosed. The tobacco product tip assembly comprises a tip portion and a body wall. The tip portion comprises a tip wall and the tip wall defines an inhalation ("draw through") chamber. The tip portion extends into a body portion. The body portion comprises a (cylindrical) body wall that defines an insertion chamber. The insertion chamber is in communication with the inhalation chamber. The body wall comprises a mechanical fastener.

In another form, the mechanical fastener comprises one or more barbs, which extend radially inwardly from the body wall into the insertion chamber.

In one form, the one or more barbs may be flexibly attached to the body wall.

In yet another form, the body wall may have an inner surface and the one or more barbs may extend radially inwardly from the inner surface into the insertion chamber.

In still another form, the mechanical fastener comprises a thread-like protrusion, preferably being helical in shape, which extends from the body wall into the insertion chamber.

In another form, the mechanical fastener comprises one or more spikes, which extend radially inwardly from the body wall into the insertion chamber.

In another form, the cigar tip does not comprise an adhesive fastening material.

In one form, the inhalation chamber and/or the insertion chamber comprise no perforations.

In one form, a tobacco product assembly is disclosed. The tobacco product assembly comprises the tobacco product tip assembly and a tobacco product, e.g., a cigar or a cigarette. The mechanical fastener is mechanically engaged with the tobacco product.

In a further form, the mechanical fastener may comprise one or more barbs, which extend radially inwardly from the body wall into the insertion chamber.

In another form, at least one of the one or more barbs is engaged with the tobacco product.

In yet another form, the mechanical fastener comprises a thread-like protrusion.

In still another form, the thread-like protrusion is engaged with the tobacco product.

In another form, the tobacco product assembly, e.g., the tobacco product tip assembly does not comprise (is essentially free of) an adhesive fastening material.

In one form, a process for producing a tobacco product assembly is disclosed. The process comprises the steps of providing the tobacco product tip assembly and inserting a tobacco product into the insertion chamber of the tobacco product tip assembly such that the mechanical fastener engages the tobacco product to form the tobacco product assembly.

DETAILED DESCRIPTION

Various aspects will now be described with reference to specific forms selected for purposes of illustration. It will be appreciated that the spirit and scope of the apparatuses, assemblies, systems, and processes disclosed herein are not limited to the selected forms. Moreover, it is to be noted that the FIGS. provided herein are not drawn to any particular proportion or scale, and that many variations can be made to the illustrated forms. Reference is made herein to FIGS. 1-6, wherein like numerals are used to designate like elements throughout.

Each of the following terms written in singular grammatical form: "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms: "includes," "including," "has," "'having," "comprises," and "comprising," and, their linguistic or grammatical variants, derivatives, and/or conjugates, as used herein, means "including, but not limited to."

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatuses, assemblies, systems, and processes disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

Occasionally, during the smoking of an un-tipped cigar or cigarette, the butt end of the cigar or cigarette may develop minor structural issues. In an effort to eliminate some of these problems, mouthpieces or tips have been developed. Some conventional tips rely on a constrictional fit with the tobacco product, e.g., the opening of the tip is snugly fit with the generally cylindrical cigar, so as to be secured thereon. This attachment method is typically referred to as "frictional" attachment or "frictional" gripping. Such frictional attachments, however, may not provide sufficient attachment to the tobacco product. Other conventional tips may utilize an adhesive fastening mechanism. Although the adhesive improves the attachment of the tobacco product to the tip assembly, the adhesive creates processing problems, which may lead to significant machine downtime for cleaning and maintenance. Also, the adhesive adds cost to the resultant tobacco product.

It has now been discovered that a tobacco product tip assembly that comprises a mechanical fastener, a non-frictional or non-constrictional mechanical fastener, provides for a significant improvement in the attachment of the tobacco product tip assembly to the tobacco product (or smoking article), as compared to the attachment achieved via conventional frictional attachment mechanisms. When the mechanical fastener is employed as discussed herein, the mechanical fastener engages, e.g., protrudes into and/or displaced, the tobacco product, which, beneficially, securely attaches the tobacco product to the tip assembly. In addition, because the mechanical fastener provides for superior attachment, the need for additional types of fasteners, e.g., adhesive fasteners, is reduced or eliminated. As such, the problems associated with these additional types of fasteners are advantageously reduced. Further, because the need for adhesive fasteners may be reduced or eliminated altogether, overall production costs may be significantly reduced.

The tobacco product tip assembly, in one form, may be used in conjunction with a suitable tobacco product, see discussion below.

The tobacco product tip assembly comprises a tip portion. The tip portion provides a passage through which an aerosol, e.g., tobacco smoke, and/or other fluid may be conveyed. The tip portion comprises a tip wall. The tip wall defines an inhalation chamber, which may be a hollow chamber through which vapor and/or fluid may pass. In some uses, the front of the tip portion may be placed in the mouth of the consumer and, upon inhalation, the vapor and/or may be drawn through the inhalation chamber and into the mouth.

The tip portion extends into a body portion. The body portion provides a volume that may hold or contain the tobacco product. The body portion may, in other cases, hold or contain other items that may be directly or indirectly related to tobacco consumption. For example, the body portion may hold or contain flexible tubing leading from a water pipe or a stem of a traditional pipe. The body portion has a back end and a front end opposite one another. The front end joins the tip portion. The body portion comprises a body wall. The body wall defines an insertion chamber, which may be utilized to hold and/or contain the tobacco product, as discussed above. In one form, the body wall is cylindrical in shape so as to accommodate cylindrically shaped tobacco products. In one form, the body wall may be tapered. In one form, the body wall may be cylindrical in part and tapered in part. The general shape of the body wall, however, is not limited to the aforementioned shapes.

The insertion chamber may be in communication with the inhalation chamber, thus allowing vapor and/or fluid to pass from the inhalation chamber, into the inhalation chamber, and ultimately into the mouth of the consumer. In some uses, the tobacco product will be inserted into the insertion chamber.

The body wall comprises a mechanical fastener. The mechanical fastener is capable of mechanically engaging with the tobacco product that is inserted into the insertion chamber. In some forms, the mechanical fastener extends radially inwardly from the body wall into the insertion chamber. More specifically, the body wall, in some forms, may have an inner surface and the mechanical fastener may extend radially inwardly from the inner surface into the insertion chamber.

In some forms, a plurality of mechanical fasteners is employed. Such forms are useful when the mechanical fastener is a barb or a spike. For example, the mechanical fasteners may be disposed at various points on the inner surface of the body wall. In a one form, mechanical fasteners may be spaced at equal radial portions of the inner surface of the body wall. In other forms, the spacing of the mechanical fasteners maybe random. In some forms, the positioning of the mechanical fasteners may be dependent upon the size, shape, and/or construction of the tobacco product.

When a tobacco product is inserted into the insertion chamber, the configuration of the body wall and the mechanical fastener disclosed herein allows the mechanical fastener to mechanically engage, e.g., protrude into and/or displace, the tobacco product, thus providing a highly secure mechanical attachment, which is a significant improvement over the typical friction fit.

Conventional tip assemblies typically utilize a constricted neck, which relies on the frictional fit of the tip assembly to the tobacco product. The mechanical attachment achieved via forms of the tip assembly disclosed herein is different from the friction fit in that the mechanical fastener actually protrudes into the tobacco product. The conventional tip assemblies do not use the mechanical fasteners that extend into the insertion chamber. As such, these conventional assemblies cannot protrude into the tobacco product and an inferior attachment, as compared to that of the present tip assembly, is achieved.

The mechanical attachment achieved via forms of the present tip assembly is also significantly different from conventional adhesive fastening mechanism, which requires the formation of an adhesive bond. The configuration of the body wall and the mechanical fastener, in some forms, does not utilize an adhesive fastening mechanism, e.g., the configuration is a non-adhesive attachment mechanism. As a result, the problems associated with adhesive fastening mechanisms, e.g., additional machine maintenance and overall product cost increases, may be beneficially reduced or eliminated. In some forms, however, the mechanical fastener discussed herein may be utilized in addition to an adhesive fastening mechanism.

The structure and construction of the mechanical fastener may vary widely. Some types of mechanical fasteners are discussed herein. Of course, these types are merely exemplary and are not intended to be limiting. Mechanical fasteners not explicitly disclosed herein are certainly contemplated.

In one form, the mechanical fastener comprises one or more barbs. The discussion herein of a singular barb may equally apply to multiple barbs. The barb may extend radially inwardly from the body wall into the insertion chamber. In one form, the body wall has an inner surface and the barb extends radially inwardly from the inner surface into the insertion chamber. The barb may also extend at an angle from back to front away from the surface of inner surface. The structure and construction of the barb may vary widely. In one form, the barbs comprise a shaft and a barbed tip. The shaft may extend from the body wall and into the insertion chamber. The barbed tip is disposed at the end of the shaft. In use, the barbed tip may engage the tobacco product as the tobacco product is inserted into the insertion chamber. The barb, in some forms, is flexibly attached to the body wall and the shaft and the barbed tip may flex as the tobacco product is inserted into the insertion chamber. This configuration allows the barbed tip to grab onto the tobacco product thus resulting in a secure attachment of the tobacco product to the tobacco product tip assembly. As discussed herein, the barb(s) may be formed into the body wall using any suitable method.

In one form, the mechanical fastener comprises a thread-like protrusion. The structure and construction of the thread-like protrusion may vary widely. The thread-like protrusion may extend radially inwardly from the body wall into the insertion chamber. In one form, the thread-like protrusion is helical in shape. The thread-like protrusion may be formed on the inner surface of the body wall. The thread-like protrusion may be in the form of actual threads and the threads extend into the insertion chamber. In use, the thread-like protrusion may engage the tobacco product and displace the body of the tobacco product as the tobacco product is inserted into the insertion chamber. This configuration allows the thread-like protrusion to grab onto the tobacco product thus resulting in a secure attachment of the tobacco product to the tobacco product tip assembly. As discussed herein, the thread-like protrusion may be formed into the body wall using any suitable method.

In one form, the mechanical fastener comprises one or more spikes. The discussion herein of a singular spike may equally apply to multiple spikes. The spike may extend radially inwardly from the body wall into the insertion chamber. In one form, the body wall has an inner surface and the spike extends radially inwardly from the inner surface into the insertion chamber. The structure and construction of the spike may vary widely. In use, the spike may engage the tobacco product as the tobacco product is inserted into the insertion chamber.

The tobacco product tip assembly, in some forms, may comprise multiple types of mechanical fasteners. The combinations of mechanical fasteners that may be employed vary widely. For example, the tobacco product tip assembly may comprise barbs in combination with threads. As another example, the tobacco product tip assembly may comprise barbs in combination with spikes. Of course, this listing is merely exemplary and other combinations of mechanical fasteners are contemplated.

The inhalation chamber, in some forms, does not have perforations therein. For example the inhalation chamber does not have any perforations on the side walls thereof. The inhalation chamber will, however, have an exit aperture at a tip of the inhalation chamber. The exit aperture allows the vapor or liquid to be drawn from the tobacco product assembly. In other forms, the inhalation chamber may have perforations. Perforations are conventionally employed to provide for passage of smoke through the side walls. Similarly, the insertion chamber, in some forms, does not have perforations therein. In other forms, the insertion chamber may have perforations. In one form, neither the inhalation chamber nor the insertion chamber has perforations therein.

In one form, the term "tobacco product" or "smoking article" may generally relate to "smoked tobacco" products, e.g., tobacco-containing products that are lighted and smoked by the consumer. Examples of tobacco products include cigarettes, cigars, little cigars, blunts, and cigarillos. This listing is not intended to be exclusive and other types of suitable tobacco products are certainly contemplated. In some forms, the tobacco product may comprise shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the like. Genetically modified tobacco may also be used. Additionally, the tobacco material can also include a supplemental amount of vegetable or plant fibers or particles such as particles or shreds of lettuce, cotton, flax, beet fiber, cellulosic fibers, blends thereof and the like. In some forms, the tobacco product may include, but is not limited to, flue-cured tobacco, Burley tobacco, Maryland tobacco, Oriental tobacco, rare tobacco, specialty tobacco, reconstituted tobacco, blends thereof and the like. The tobacco product and/or the components thereof may be pasteurized. In one form, the tobacco product and/or the components thereof may be fermented.

The tobacco product tip assembly (or the components thereof) may be constructed of any suitable material and such construction materials may vary widely. For example, the tobacco product tip assemble may be formed of polymeric materials, e.g., plastics, wood, (rigid) cloth, metal, natural materials, etc. In one form, the tobacco product tip assembly may be fabricated from granulated tobacco or vegetable material put together under pressure using a vegetable gum as a binder. The tobacco product tip may be formed by conventional molding processes, e.g., injection molding.

In some forms, the tobacco product tip may be produced in various colors, textures, and/or shapes and may include text or other indicia that may or may not relate to the tobacco product. Such variations may be desirable from an aesthetic perspective.

The tobacco product tip assembly, in some forms, may further comprise a filter material. The filter material serves to filter the vapor, e.g., tobacco smoke, or liquid flowing through the tobacco product tip assembly. The filter material may be contained in (at least a portion of) the inhalation chamber. In one form, the filter material may be contained in (at least a portion of) the insertion chamber. In one form, the filter material may be contained in (at least a portion of) both the inhalation chamber and the insertion chamber.

In one form, tobacco product assembly is disclosed. The tobacco product assembly comprises the tobacco product tip assembly and a tobacco product. The mechanical fastener is engaged, e.g., mechanically engaged with the tobacco product. For example, as discussed above, the mechanical fastener protrudes into the tobacco product and/or displaces at least a portion of the tobacco product, thus locking onto the tobacco product to provide the mechanical attachment. In one form, when barbs are utilized as the mechanical fastener, the barb tip of the tobacco product tip assembly penetrates the outer layer(s) of the tobacco product, thus providing the mechanical attachment. In one form, when a thread-like protrusion is utilized as the mechanical fastener, the (helical) thread-like protrusion displaces at least a portion of the tobacco product, thus locking onto the tobacco product. Conventional tobacco product assemblies do not employ the mechanical fastener. As such, conventional tobacco product assemblies have no mechanical attachment of the tobacco product tip assembly and the tobacco product.

In some forms, the attachment of the tobacco product tip assembly and the tobacco product relies on the mechanical fastener and the tobacco product assembly does not comprise an adhesive fastening material, e.g., the tobacco product tip assembly portion does not comprise and adhesive fastening material. Beneficially, the problems associated with using an adhesive fastening material, e.g., glue migration and build-up in machinery, glue spillage, plugging of glue daubers, may be avoided.

In one form, a process for producing a tobacco product assembly is disclosed. The process comprises the step of providing a tobacco product tip assembly as discussed herein. The process further comprises the step of inserting a tobacco product into the insertion chamber. The insertion of the tobacco product into the insertion chamber allows the mechanical fastener to mechanically engage with the tobacco product. As a result, a tobacco product assembly that has a mechanical attachment between the tobacco product tip assembly and the tobacco product is formed.

Referring now to the FIGS., FIG. 1 is a perspective view of one form of a tobacco product tip assembly. The form of FIG. 1 employs multiple barbs as the mechanical fastener. As shown in FIG. 1, tobacco product tip assembly 100 comprises tip portion 102 and body portion 104. Tip portion 102 comprises tip wall 106 and has front end 108 and back end 110. Tip wall 106 defines inhalation chamber 112.

Body portion 104 has front end 114 and back end 116 and comprises body wall 118. Body wall 118 defines insertion chamber 120. Inhalation chamber 112 is in communication with insertion chamber 120. Body wall 116 has inner surface 122. Mechanical fasteners, e.g., barbs, 124 extend radially inwardly from inner surface 122 and into insertion chamber 120.

In use, the tobacco product is inserted into insertion chamber 120 and barbs 124 mechanically engage with the tobacco product. Upon lighting and inhalation of the tobacco product by the consumer, tobacco smoke is drawn through the tobacco product and/or insertion chamber 120, into inhalation chamber 112, and out the tip of the inhalation chamber.

FIG. 2 is a perspective view of one form of a tobacco product tip assembly. The form of FIG. 2 employs a thread-like protrusion as the mechanical fastener. As shown in FIG. 2, tobacco product tip assembly 200 comprises tip portion 202 and body portion 204. Tip portion 202 comprises tip wall 206 and has front end 208 and back end 210. Tip wall 206 defines inhalation chamber 212.

Body portion 204 has front end 214 and back end 216 and comprises body wall 218. Body wall 218 defines insertion chamber 220. Inhalation chamber 212 is in communication with insertion chamber 220. Body wall 216 has inner surface 222. Mechanical fastener, e.g., helical threads, 224 extends radially inwardly from inner surface 222 and into insertion chamber 220.

In use, the tobacco product is inserted into insertion chamber 220 and threads 224 mechanically engage with the tobacco product. In such a form, the insertion of the tobacco product into the insertion chamber may involve the rotation of the tobacco product and/or the rotation of the tobacco product tip assembly so as to facilitate the mechanical engagement of the helical threads.

FIG. 3 is a longitudinal cross-sectional view of the tobacco product tip assembly shown in FIG. 1. Corresponding numbers in FIG. 3 correspond to the respective numbers in FIG. 1. For example tip portion 302 in FIG. 3 corresponds to tip portion 102 in FIG. 1.

FIG. 4 is a longitudinal cross-sectional view of the tobacco product tip assembly shown in FIG. 2. Corresponding numbers in FIG. 4 correspond to the respective numbers in FIG. 2. For example tip portion 402 in FIG. 4 corresponds to tip portion 202 in FIG. 2.

FIG. 5 is an enlarged detail view of the mechanical fasteners of the form of FIG. 1. Corresponding numbers in FIG. 5 correspond to the respective numbers in FIG. 1. FIG. 5 shows barbs 524 extending radially inwardly from inner surface 522 of body wall 518 and into insertion chamber 120. Each barb 524 comprises shaft 526 and barbed tip 528. Shaft 526 extends from inner surface 522 and into insertion chamber 520. Barbed tip 528 is disposed at a distal end of shaft 526. In use, barbed tips 528 engage the tobacco product as the tobacco product is inserted into insertion chamber 520.

FIG. 6 is an enlarged detail view of the mechanical fasteners of the form of FIG. 2. Corresponding numbers in FIG. 6 correspond to the respective numbers in FIG. 2. FIG. 6 shows helical threads 624 extending radially inwardly from inner surface 622 of body wall 618 and into insertion chamber 620. In use, helical threads 624 engage the tobacco product as the tobacco product is inserted into insertion chamber 620.

Illustrative, non-exclusive examples of systems and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A1. A tobacco product tip assembly comprising: a tip portion comprising a tip wall defining an inhalation chamber; the tip portion extending into a body portion comprising a body wall defining an insertion chamber, the insertion chamber being in communication with the inhalation chamber; the body wall comprising a mechanical fastener.

A2. The tobacco product tip assembly of paragraph A1, wherein the mechanical fastener comprises one or more barbs extending radially inwardly from the body wall into the insertion chamber.

A3. The tobacco product tip assembly of paragraph A2, wherein the one or more barbs are flexibly attached to the body wall.

A4. The tobacco product tip assembly of paragraph A1, wherein the body wall has an inner surface and wherein one or more barbs extend radially inwardly from the inner surface into the insertion chamber.

A5. The tobacco product tip assembly of paragraph A1, wherein the mechanical fastener comprises a thread-like protrusion.

A6. The tobacco product tip assembly of paragraph A5, wherein the thread-like protrusion extends radially extends from the body wall into the insertion chamber.

A7. The tobacco product tip assembly of paragraph A1, wherein the mechanical fastener comprises one or more spikes extending radially inwardly from the body wall into the insertion chamber.

A8. The tobacco product tip assembly of paragraph A1, wherein the cigar tip does not comprise an adhesive fastening material.

A9. The tobacco product tip assembly of paragraph A1, wherein the body wall is cylindrical.

A10. The tobacco product tip assembly of paragraph A1, wherein the inhalation chamber and/or the insertion chamber comprise no perforations.

B1. A tobacco product assembly comprising: a tobacco product tip assembly comprising: a tip portion comprising tip walls defining an inhalation chamber; the tip portion extending into a body portion comprising a body wall defining an insertion chamber, the insertion chamber being in communication with the inhalation chamber; the body wall comprising a mechanical fastener; and a tobacco product, wherein the mechanical fastener is engaged with the tobacco product.

B2. The tobacco product assembly of paragraph B1, wherein the mechanical fastener comprises one or more barbs extending radially inwardly from the body wall into the insertion chamber.

B3. The tobacco product assembly of paragraph B2, wherein at least one of the one or more barbs is engaged with the tobacco product.

B4. The tobacco product assembly of paragraph B1, wherein the mechanical fastener comprises a thread-like protrusion.

B5. The tobacco product assembly of paragraph B4, wherein the thread-like protrusion is engaged with the tobacco product.

B6. The tobacco product assembly of paragraph B1, wherein the tobacco product tip assembly does not comprise an adhesive fastening material.

C1. A process for producing a tobacco product assembly, the process comprising the steps of: (a) providing a tobacco product tip assembly comprising: a tip portion comprising tip walls defining an inhalation chamber; the tip portion extending into a body portion comprising a body wall defining an insertion chamber, the insertion chamber being in communication with the inhalation chamber; the body wall comprising a mechanical fastener; and (b) inserting a tobacco product into the insertion chamber such that the mechanical fastener engages the tobacco product to form the tobacco product assembly.

C2. The process of paragraph C1, wherein the mechanical fastener comprises one or more barbs extending radially inwardly from the body wall into the insertion chamber, and wherein at least one of the one or more barbs engages the tobacco product.

C3. The process of paragraph C1, wherein the mechanical fastener comprises a thread-like protrusion, and wherein the thread-like protrusion engages the tobacco product.

C4. The process of paragraph C1, wherein the tobacco product tip assembly does not comprise an adhesive fastening material.

PCT1. A tobacco product tip assembly comprising: a tip portion comprising a tip wall defining an inhalation chamber; the tip portion extending into a body portion comprising a body wall defining an insertion chamber, the insertion chamber being in communication with the inhalation chamber; the body wall comprising a mechanical fastener.

PCT2. The tobacco product tip assembly of paragraph PCT1, wherein the mechanical fastener comprises one or more barbs extending radially inwardly from the body wall into the insertion chamber.

PCT3. The tobacco product tip assembly of paragraph PCT2, wherein the one or more barbs are flexibly attached to the body wall.

PCT4. The tobacco product tip assembly of any of the above paragraphs, wherein the body wall has an inner surface and wherein one or more barbs extend radially inwardly from the inner surface into the insertion chamber.

PCT5. The tobacco product tip assembly of any of the above paragraphs, wherein the mechanical fastener comprises a thread-like protrusion.

PCT 6. The tobacco product tip assembly of paragraph PCT5, wherein the thread-like protrusion extends radially extends from the body wall into the insertion chamber.

PCT 7. The tobacco product tip assembly of any of the above paragraphs, wherein the mechanical fastener comprises one or more spikes extending radially inwardly from the body wall into the insertion chamber.

PCT 8. The tobacco product tip assembly of any of the above paragraphs, wherein the cigar tip does not comprise an adhesive fastening material.

PCT 9. The tobacco product tip assembly of any of the above paragraphs, wherein the body wall is cylindrical.

PCT10. The tobacco product tip assembly of any of the above paragraphs, wherein the inhalation chamber and/or the insertion chamber comprise no perforations.

PCT11. A tobacco product assembly comprising: a tobacco product tip assembly comprising: a tip portion comprising tip walls defining an inhalation chamber; the tip portion extending into a body portion comprising a body wall defining an insertion chamber, the insertion chamber being in communication with the inhalation chamber; the body wall comprising a mechanical fastener; and a tobacco product, wherein the mechanical fastener is engaged with the tobacco product.

PCT12. The tobacco product assembly of paragraph PCT11, wherein the mechanical fastener comprises one or more barbs extending radially inwardly from the body wall into the insertion chamber.

PCT13. The tobacco product assembly of paragraph PCT12, wherein at least one of the one or more barbs is engaged with the tobacco product.

PCT14. The tobacco product assembly of any of the above paragraphs PCT11-PCT13, wherein the mechanical fastener comprises a thread-like protrusion.

PCT15. The tobacco product assembly of paragraph PCT14, wherein the thread-like protrusion is engaged with the tobacco product.

PCT16. The tobacco product assembly of any of the above paragraphs PCT11-PCT15, wherein the tobacco product tip assembly does not comprise an adhesive fastening material.

PCT17. A process for producing a tobacco product assembly, the process comprising the steps of: (a) providing a tobacco product tip assembly comprising: a tip portion comprising tip walls defining an inhalation chamber; the tip portion extending into a body portion comprising a body wall defining an insertion chamber, the insertion chamber being in communication with the inhalation chamber; the body wall comprising a mechanical fastener; and (b) inserting a tobacco product into the insertion chamber such that the mechanical fastener engages the tobacco product to form the tobacco product assembly.

PCT18. The process of paragraph PCT17, wherein the mechanical fastener comprises one or more barbs extending radially inwardly from the body wall into the insertion chamber, and wherein at least one of the one or more barbs engages the tobacco product.

PCT19. The process of paragraphs PCT17 or PCT18, wherein the mechanical fastener comprises a thread-like protrusion, and wherein the thread-like protrusion engages the tobacco product.

PCT20. The process of any of paragraphs PCT17-PCT19, wherein the tobacco product tip assembly does not comprise an adhesive fastening material.

INDUSTRIAL APPLICABILITY

The assemblies and processes disclosed herein are applicable to the tobacco industry, in particular that portion directed to products for smoking enjoyment.

While the invention has been described in detail, modifications within the spirit and scope will be readily apparent to those of skill in the art. In addition, it should be understood that aspects and portions of various forms and various features recited below and/or in the appended claims may be combined or interchanged either in whole or in part. In the foregoing descriptions of the various forms, those forms which refer to another form may be appropriately combined with other forms as will be appreciated by one of skill in the art. Furthermore, those of ordinary skill in the art will appreciate that the foregoing description is by way of example only, and is not intended to be limiting.

We claim:

1. A tobacco product tip assembly comprising:

a tip portion comprising a tip wall defining an inhalation chamber;

the tip portion extending into a body portion comprising a body wall defining an insertion chamber, the insertion chamber being in fluid communication with the inhalation chamber;

the body wall comprising one or more barbs, said one or more barbs each having a barbed tip with two ends;

each barbed tip extending inward into the insertion chamber;

one of the two ends is directed outward toward the body wall and the other of the two ends is directed toward the tip portion; and wherein neither the tip wall or body wall has perforations.

2. The tobacco product tip assembly of claim 1, wherein the one or more barbs are flexibly attached to the body wall, so as to flex as a tobacco product is inserted into the insertion chamber.

3. The tobacco product tip assembly of claim 1, wherein the tobacco product tip assembly does not comprise an adhesive fastening material.

4. The tobacco product tip assembly of claim 1, wherein the body wall is cylindrical.

5. A tobacco product assembly comprising:

a tobacco product tip assembly comprising:

a tip portion comprising a tip wall defining an inhalation chamber;

the tip portion extending into a body portion comprising a body wall defining an insertion chamber, the insertion chamber being in fluid communication with the inhalation chamber;

the body wall comprising one or more barbs, said one or more barbs each having a barbed tip with two ends;

each barbed tip extending inward into the insertion chamber;

one of the two ends is directed outward toward the body wall and the other of the two ends is directed toward the tip portion; and wherein neither the tip wall or body wall has perforations; and a tobacco product positioned in the insertion chamber.

6. The tobacco product assembly of claim 5, wherein said at least one of the one or more barbs is engaged with the tobacco product.

7. The tobacco product assembly of claim 5, wherein the tobacco product tip assembly does not comprise an adhesive fastening material.

8. A process for producing a tobacco product assembly, the process comprising the steps of:

(a) providing a tobacco product tip assembly comprising:

a tip portion comprising a tip wall defining an inhalation chamber;

the tip portion extending into a body portion comprising a body wall defining an insertion chamber, the insertion chamber being in fluid communication with the inhalation chamber;

the body wall comprising one or more barbs, said one or more barbs each having a barbed tip with two ends;

each barbed tip extending inward into the insertion chamber;

one of the two ends is directed outward toward the body wall and the other of the two ends is directed toward the tip portion; and wherein neither the tip wall or body wall has perforations; and (b) inserting a tobacco product into the insertion chamber to form the tobacco product assembly.

9. The process of claim 8, wherein at least one of the one or more barbs engages the tobacco product.

10. The process of claim 8, wherein the tobacco product tip assembly does not comprise an adhesive fastening material.

* * * * *